US010154337B2

(12) United States Patent
Chang

(10) Patent No.: US 10,154,337 B2
(45) Date of Patent: Dec. 11, 2018

(54) AUDIO SPEAKER WITH VISUAL PERFORMANCE INDICATOR

(71) Applicant: MiiCs & Partners (Shenzhen) Co., Ltd., Shenzhen (CN)

(72) Inventor: Jen-Tsorng Chang, New Taipei (TW)

(73) Assignee: MiiCs & Partners (Shenzhen) Co., Ltd., Shenzhen (CN)

( * ) Notice: Subject to any disclaimer, the term of this patent is extended or adjusted under 35 U.S.C. 154(b) by 342 days.

(21) Appl. No.: 15/096,232

(22) Filed: Apr. 11, 2016

(65) Prior Publication Data

US 2016/0341416 A1 Nov. 24, 2016

(30) Foreign Application Priority Data

May 19, 2015 (CN) ..... 2015 1 0255256

(51) Int. Cl.

| | |
|---|---|
| ***H04R 1/28*** | (2006.01) |
| ***H04R 1/02*** | (2006.01) |
| ***H04R 29/00*** | (2006.01) |
| ***H04R 7/04*** | (2006.01) |
| ***A63J 17/00*** | (2006.01) |

(52) U.S. Cl.

CPC ..... *H04R 1/288* (2013.01); *H04R 7/045* (2013.01); *H04R 29/008* (2013.01); *A63J 17/00* (2013.01); *H04R 1/028* (2013.01); *H04R 2499/15* (2013.01)

(58) Field of Classification Search

CPC ..... H04R 1/023; H04R 1/028; H04R 7/045; H04R 29/008; H04R 2499/15; A63J 17/00; G09B 15/02; G09B 15/023; G09B 15/04

USPC ..... 381/306, 333, 388

See application file for complete search history.

(56) References Cited

U.S. PATENT DOCUMENTS

| | | | | |
|---|---|---|---|---|
| 3,241,419 A * | 3/1966 | Gracey | G09F 19/18 | 353/15 |
| 3,623,392 A * | 11/1971 | Boyer | A63J 17/00 | 252/299.1 |
| 4,265,159 A * | 5/1981 | Liebman | G09F 19/20 | 340/815.74 |
| 5,115,472 A * | 5/1992 | Park | H04R 1/028 | 310/324 |
| 2016/0084493 A1* | 3/2016 | Salter | B60Q 3/85 | 362/510 |

* cited by examiner

*Primary Examiner* — Jesse A Elbin

(74) *Attorney, Agent, or Firm* — ScienBiziP, P.C.

(57) ABSTRACT

An audio speaker includes a glass, a light emitting device, a filter device, and a vibration device. The glass includes light scattering patterns and guides incoming light onto the light scattering patterns. The light emission device includes light emitting members and a control member. The filter device translates an audio signal to a control signal taking account of a plurality of different frequency bands, and transmits the control signals to the vibration device and the light emission device. The vibration device translates the control signals to controlled current applied to the light emitting members. The light intensities of the light emitting member relate to the controlled current and correspond to a height of illumination of the light scattering patterns.

15 Claims, 4 Drawing Sheets

AUDIO SPEAKER WITH VISUAL PERFORMANCE INDICATOR

FIELD

The subject matter herein generally relates to an audio speaker with visible performance indication.

BACKGROUND

An audio speaker having a flat glass provides acceptable sound in multiple directions, the audio speaker may have an lighting device and emits a colorfully light projecting on the glass. However, the audio speaker cannot provide a plurality of signal patterns changed to follow a variety of audio signals on the glass.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Implementations of the present technology will be described, by way of example only, with reference to the attached figures.

DETAILED DESCRIPTION

Figure 1:
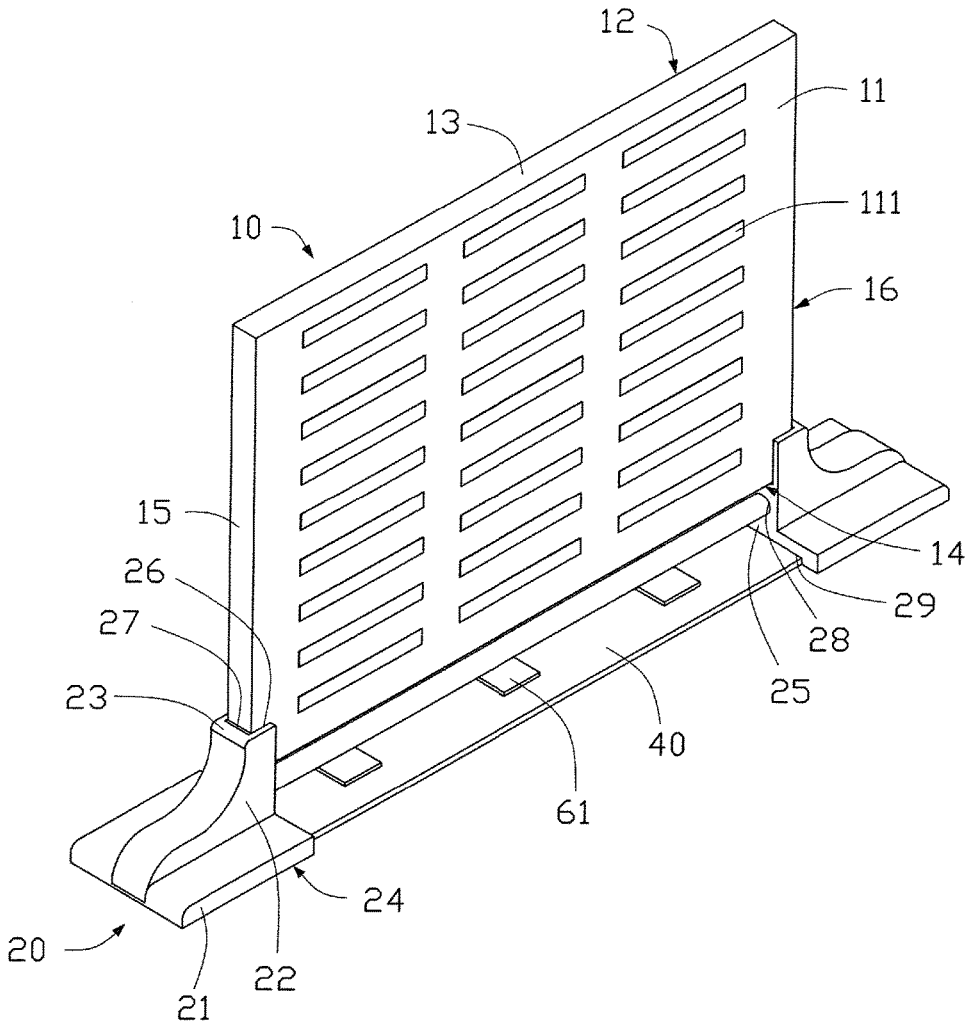
FIG. 1 is an isometric front view of an embodiment of an audio speaker.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising," when utilized, means "including, but not necessarily limited to;" it specifically indicates open-ended inclusion or membership in the so-described combination, group, series, and the like.

The present disclosure relates to an audio speaker with visible performance indication.

Figure 3:
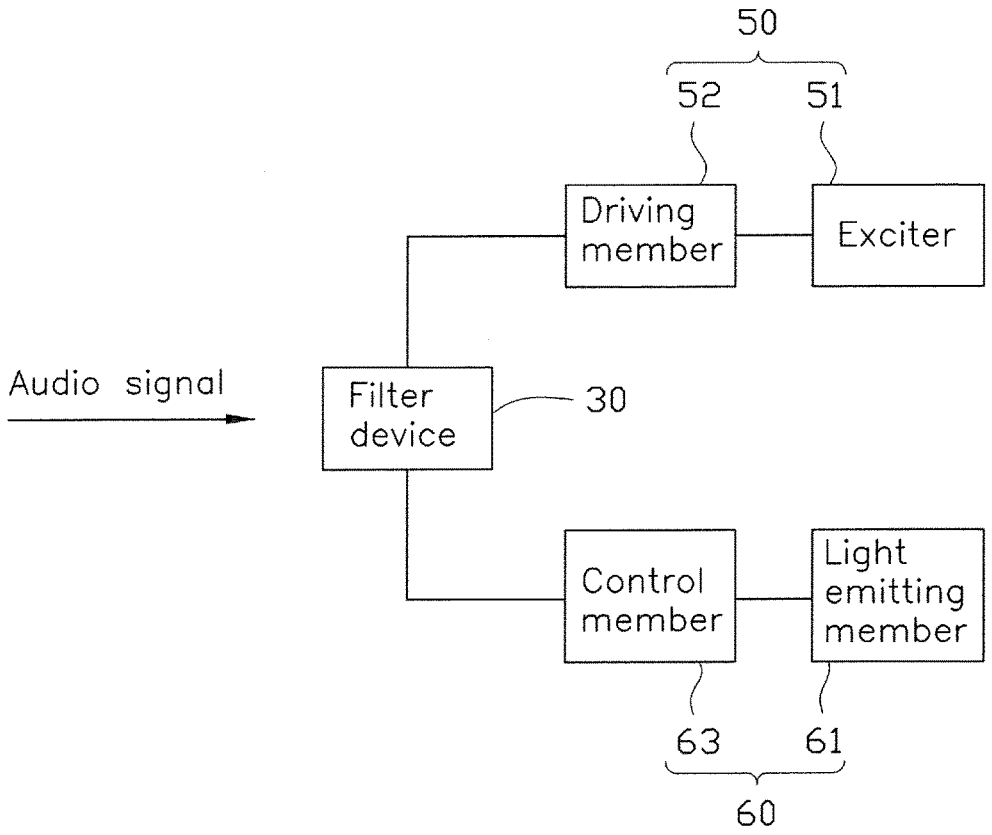
FIG. 3 is a block diagram illustrating the embodiment of the audio speaker of FIG. 1.

FIG. 1 shows an audio speaker 100; the audio speaker 100 includes a glass 10, two holders 20, a filter device 30, a circuit board 40, a vibration device 50, and a light emission device 60. The filter device 30, the vibration device 50, and the light emission device 60 are shown in FIG. 3.

The glass 10 can be excited to vibrate for generating audio sounds, and has a rectangular shape and is configured to guide lights. In at least one embodiment, the glass 10 is a transparent tempered glass substrate. The glass 10 includes a first surface 11, a second surface 12 opposite to the first surface 11, a first top surface 13, a first bottom surface 14 opposite to the first top surface 13, a first side surface 15, a second side surface 16 opposite to the first side surface 15, and a plurality of light scattering patterns 111. The first top surface 13, the first bottom surface 14, the first side surface 15, and the second side surface 16 connect to each other end to end and are interconnected between the first surface 11 and the second surface 12.

The light scattering patterns 111 are positioned on the first surface 11 and are arrayed from the first side surface 15 to the second side surface 16 and are configured to indicate a variety of audio signals. In at least one embodiment, the light scattering pattern 111 includes a plurality of rectangles, the rectangles include a plurality of dots and are arranged as an array from the first top surface 13 to the first bottom surface 14. In other embodiments, the light scattering pattern can include a plurality of ellipses or circles. In at least one embodiment, the light scattering pattern 111 is formed by etching with hydrofluoric acids. In other embodiments, the light scattering pattern 111 is formed by laser cutting.

The holder 20 includes a base member 21, a supporting member 22 positioned on the base member 21, a second top surface 23, a second bottom surface 24 opposite to the second top surface 23, an inside surface 25 interconnected between the second top surface 23 and the second bottom surface 24, a first groove 26, a vibration dampening component 27 positioned on the first groove 26, a second groove 28, and a third groove 29. In at least one embodiment, the base member 21 can have a shape that substantially resembles a plane, the supporting member 22 can have a shape that substantially resembles a letter "L". The inside surfaces 25 of the holders 20 are opposite to each other. The first groove 26 is defined and interconnects the inside surface 25 and the second top surface 23. The first grooves 26 of the holders 20 correspond to each other and are configured to hold the glass 10 with the vibration dampening components 27. The vibration dampening component 27 is configured to damp the vibration of the glass 10. The second groove 28 and the third groove 29 are defined on the inside surface 25. The third groove 29 is positioned with the second bottom surface 24, and the second groove 28 is positioned between the first groove 26 and the second groove 28. The second grooves 28 and the third grooves 29 of the holders 20 correspond to each other.

The filter device 30 couples to the vibration device 50 and the light emission device 60. The filter device 30 is configured to translate an audio signal to a control signal and transmit the control signal to the vibration device 50 and the light emission device 60. The control signal can relate to a plurality of different frequency bands. In the embodiment, the filter device 30 is a band-pass filter.

Figure 2:
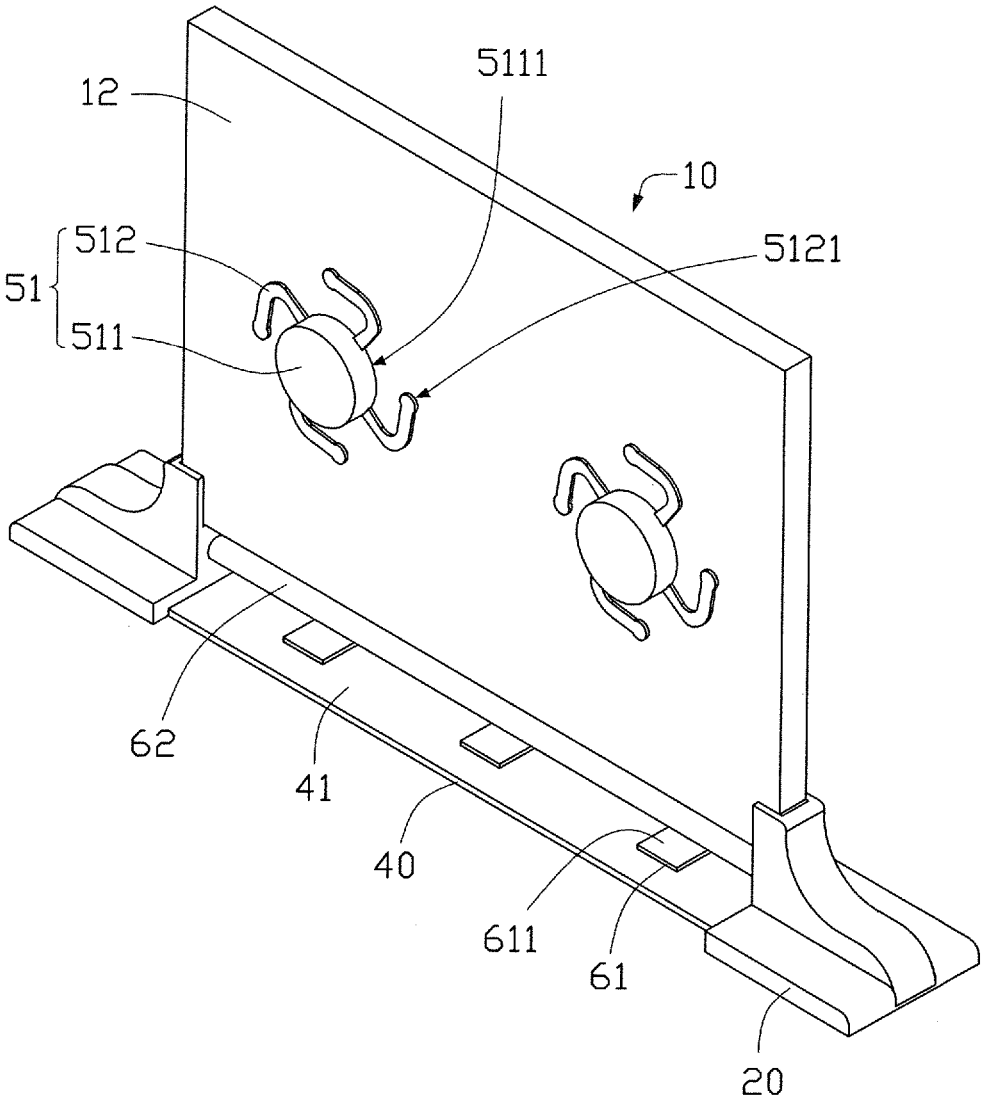
FIG. 2 is an isometric back view of the embodiment of the audio speaker of FIG. 1.

FIG. 2 shows a back view of the audio speaker 100. The circuit board 40 includes a third top surface 41, the third top surface 41 corresponds to the first bottom surface 14. In the illustrated embodiment, the circuit board 40 is coupled to the third grooves 29 in the holders 20.

FIG. 3 is a block diagram of the illustrated embodiment of the audio speaker 100. The vibration device 50 is coupled to the glass 10 and includes an exciter 51 and a driving member 52. The exciter 51 is configured to make the glass 10 vibrate and includes a main body 511 and a plurality of fixed members 512. In at least one embodiment, the main body 511 and the fixed members 512 are integrally manufactured. The main body 511 is configured to make the exciter 51 vibrate, the fixed members 512 are configured to couple to the second surface 12 of the glass 10, and the exciter 51 is positioned on the second surface 12 of the glass 10. In the illustrated embodiment, the main body 511 includes a coil (not shown) and a third surface 5111 corresponding to the second surface 12. The coil is moved by a fluctuating magnetic field and vibrates the exciter 51. The fixed members 512 includes a fourth surface 5121 aligned with the third surface 5111, the third surface 5111 and the fourth surface 5121 being glued to the second surface 12.

The driving member 52 is connected electrically with the filter device 30 and the exciter 51. The driving member 52 is configured to catch the frequency bands of the control signal and translates the frequency bands into a fluctuating current. The fluctuating current is transmitted to the main body 511 and excites the exciter 51 to vibrate in accordance with the frequency bands.

The light emission device 60 includes a plurality of light emitting members 61, a light coupling member 62, and a control member 63. The light emitting members 61 are positioned on the third top surface 41 of the circuit board 40 and are connected electrically with the circuit board 40. The light emitting member 61 includes a light emitting surface 611 corresponding to the first bottom surface 14. Each one of the light emitting members 61 correspond to one of the light scattering patterns 111. In the embodiment, the light emitting member 61 is a light emitting diode. In another embodiment, the light emitting member 61 is a laser diode.

The light coupling member 62 is coupled to the second grooves 28 and is configured to input light to the glass 10 from the light emitting member 61. In at least one embodiment, the light emission device 60 may not include a light coupling member 62, and the holder 20 may not include a second groove 28.

Figure 4:
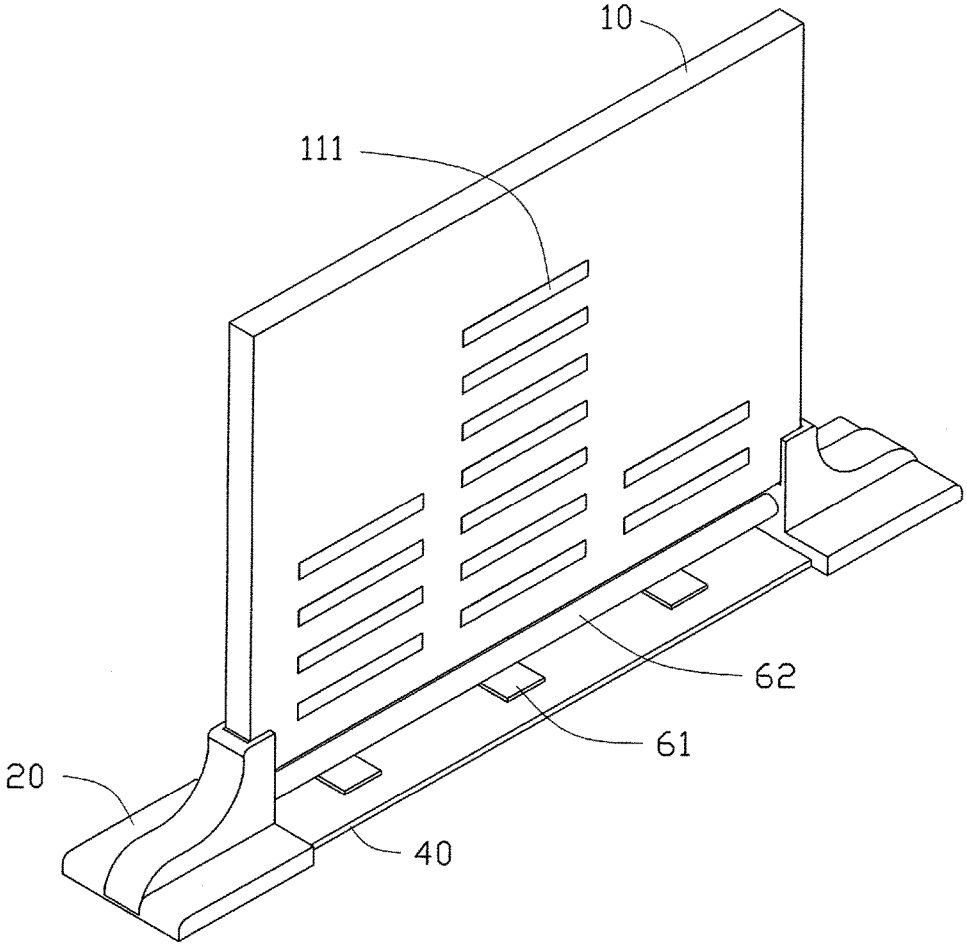
FIG. 4 is an isometric view of the embodiment of the audio speaker of FIG. 1.

The control member 63 is connected electrically with the filter device 30 and the light emitting members 61, and configured to translate the control signal to a controlled current corresponding to the frequency bands from the filter device 30. The controlled current is transmitted to the light emitting members 61. FIG. 4 illustrates the intensities and modes of different the frequency bands of the audio signals. Each one of the light emitting members 61 corresponds to the controlled current translated from the frequency band. The intensities of the light emitting members 61 are related to intensity of the controlled current and correspond to a height of illumination of the light scattering patterns 111.

In at least one embodiment, the filter device 30, the driving member 52, and the control member 53 are not positioned on the third top surface 41. In other embodiments, the filter device 30, the driving member 52, and the control member 53 may be positioned on the third top surface 41.

The audio signal is transmitted to the filter device 30. The filter device 30 translates the audio signal to the control signal based on the frequency bands. The control signal is transmitted to the vibration device 50 and the light emission device 60. The driving member 52 catches the frequency bands of the control signal and translates the frequency bands to the fluctuating current. The fluctuating current is transmitted to the exciter 51 and excites the glass 10 to vibrate so as to follow the frequency bands. Simultaneously, the control member 63 translates the control signal to the controlled current corresponding to the frequency bands and the controlled current is transmitted to the light emitting members 61 to emit light. The light intensities of the light emitting members 61 relate to intensities of the controlled current. The light coupling member 62 inputs light to the glass 10 and the light is guided by the glass 10 and directed onto the light scattering patterns 111. The heights of illumination of the light scattering patterns 111 correspond to the light intensities of the light emitting members 61.

The embodiments shown and described above are only examples. Many details are often found in the art such as the other features of an audio speaker with a visible performance indication. Therefore, many such details are neither shown nor described. Even though numerous characteristics and advantages of the present technology have been set forth in the foregoing description, together with details of the structure and function of the present disclosure, the disclosure is illustrative only, and changes may be made in the details, including in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An audio speaker comprising:

a glass including at least one light scattering pattern and configured to guiding a light to position on the light scattering pattern;

a vibration device coupled to the glass and configured to making the glass to vibrate;

a light emission device including at least one light emitting member and a control member; and a filter device coupled to the vibration device and the light emission device, the filter device configured to translating an audio signal to a control signal having a plurality of frequency bands different from each other and to transmit the control signal to the vibration device and the light emission device;

wherein the control member is configured to translate the control signal to a controlled current corresponding to the frequency bands, and light intensity of the light emitting member is related to the controlled current and corresponds to a luminous height of the light scattering pattern.

2. The audio speaker in accordance with claim 1, wherein the audio speaker includes two holders, the holder includes a first groove, and a vibration dampening component, the first groove is configured to hold the glass, the vibration dampening component is positioned between the first groove and the glass.

3. The audio speaker in accordance with claim 2, wherein the light emission device includes a light coupling member, the holder includes a second groove configured to hold the light coupling member, the light coupling member is configured to couple the light from the light emitting member and transmits the light into the glass.

4. The audio speaker in accordance with claim 1, wherein the glass includes a first surface, a second surface opposite to the first surface, a first top surface, a first bottom surface opposite to the first top surface, a first side surface, and a second side surface opposite to the first side surface, the first top surface, the first bottom surface, the first side surface, and the second side surface connect to each other end to end and are interconnected between the first surface and second surface, the light scattering pattern is positioned on the first surface and is configured to show a variety of the audio signal.

5. The audio speaker in accordance with claim 4, wherein the light scattering pattern includes a plurality of rectangles, the rectangles includes a plurality of dots and are arrayed from the first top surface to the first bottom surface.

6. The audio speaker in accordance with claim 4, wherein the vibration device includes an exciter, and a driving member connected electrically with the filter device and the exciter, the exciter is positioned on the second surface of the glass, the driving member is configured to catch the control signal and excites the exciter to vibrate follow the frequency bands.

7. The audio speaker in accordance with claim 1, wherein the light scattering pattern is formed by etching with hydrofluoric acids.

8. The audio speaker in accordance with claim 1, wherein the light scattering pattern is formed by lasers cutting.

9. The audio speaker in accordance with claim 1, wherein the audio speaker includes a circuit board, the light emitting member is positioned on the circuit board.

10. An audio speaker comprising:

a glass including a plurality of light scattering patterns and configured to guiding a light to position on the light scattering pattern, the light scattering pattern configured to showing a variety of an audio signal;

a vibration device coupled to the glass and configured to making the glass to vibrate;

a light emission device including a plurality of light emitting members, and a control member; and a filter device coupled to the vibration device and the light emission device and configured to translating the audio signal to a control signal having a plurality of frequency bands different from each other and transmitting the control signals to the vibration device and the light emission device;

wherein the control member configured to translate the control signal to a controlled current corresponding to the frequency bands, light intensity of the light emitting member is related to the controlled current and corresponds to a luminous height of the light scattering pattern.

11. The audio speaker in accordance with claim 10, wherein the audio speaker includes two holders, the holder includes a first groove, and a vibration dampening component, the first groove is configured to hold the glass, the vibration dampening component is positioned between the first groove and the glass.

12. The audio speaker in accordance with claim 10, wherein the glass includes a first surface, a second surface opposite to the first surface, a first top surface, a first bottom surface opposite to the first top surface, a first side surface, and a second side surface opposite to the first side surface, the first top surface, the first bottom surface, the first side surface, and the second side surface connect to each other end to end and are interconnected between the first surface and second surface, the light scattering patterns are positioned on the first surface and are arrayed from the first side surface to the second side surface.

13. The audio speaker in accordance with claim 12, wherein the light scattering pattern includes a plurality of rectangles, the rectangles includes a plurality of dots and is arrayed from the first top surface to the first bottom surface.

14. The audio speaker in accordance with claim 12, wherein the vibration device includes an exciter, and a driving member connected electrically with the filter device and the exciter, the exciter is positioned on the second surface of the glass, the driving member is configured to catch the control signal and excites the exciter to vibrate follow the frequency bands.

15. The audio speaker in accordance with claim 10, wherein the audio speaker includes a circuit board, the light emitting member is positioned on the circuit board.

* * * * *